US006712233B2

(12) United States Patent
Arshinoff

(10) Patent No.: US 6,712,233 B2
(45) Date of Patent: Mar. 30, 2004

(54) LID WITH HINGE FOR PLASTIC PAIL

(75) Inventor: Stephen H. Arshinoff, 167 Lord Seaton Road, Willowdale, Ontario, M2P 1K9 (CA)

(73) Assignee: Stephen H. Arshinoff, Willowdale (CA)

( * ) Notice: Subject to any disclaimer, the term of this patent is extended or adjusted under 35 U.S.C. 154(b) by 0 days.

(21) Appl. No.: 09/804,966

(22) Filed: Mar. 13, 2001

(65) Prior Publication Data

US 2002/0134783 A1 Sep. 26, 2002

(51) Int. Cl.[7] ..... B65D 7/40
(52) U.S. Cl. ..... 220/276; 220/847
(58) Field of Search ..... 220/268, 266, 220/270, 276, 259.1, 837, 847, 254.3; 215/256, 258, 235, 237

(56) References Cited

U.S. PATENT DOCUMENTS

| | | | | | |
|---|---|---|---|---|---|
| 3,272,368 | A | * | 9/1966 | Van Baarn | 215/235 |
| 3,421,654 | A | * | 1/1969 | Hexel | 220/254.3 |
| 4,531,650 | A | * | 7/1985 | Friendship | 215/256 |
| 4,790,448 | A | * | 12/1988 | Ostrum et al. | 220/276 |
| 4,919,286 | A | * | 4/1990 | Agbay, Sr. | 215/256 |
| 4,930,656 | A | * | 6/1990 | Blanchette | 220/276 |
| 4,934,556 | A | * | 6/1990 | Kleissendorf | 215/256 |
| 5,145,088 | A | * | 9/1992 | Goujon | 220/276 |
| 5,238,135 | A | * | 8/1993 | Landis | 220/276 |
| 5,273,176 | A | * | 12/1993 | Diaz | 220/276 |
| 5,398,829 | A | * | 3/1995 | Stubbs | 215/256 |
| 5,605,240 | A | * | 2/1997 | Guglielmini | 215/256 |
| 5,617,968 | A | * | 4/1997 | Luburic | 220/276 |
| 6,257,435 | B1 | * | 7/2001 | Chedister et al. | 220/276 |

FOREIGN PATENT DOCUMENTS

| | | |
|---|---|---|
| CA | 2019225 | 12/1991 |
| WO | 98/56675 | * 12/1998 |

OTHER PUBLICATIONS

Abstract of Japanese Patent No. JP2000142762, "Plastic hinge cap for container has pair of projections extending from upper edge of slit towards lower side of cylinder, near coupling strap, within cylinder", 1 p.

Abstract of Japanese Patent No. JP2000142758, "Multiple sample chamber assemblies for use with conventional laboratory batch centrifuges", 1 p.

* cited by examiner

*Primary Examiner*—Nathan J. Newhouse
(74) *Attorney, Agent, or Firm*—Webb Ziesenheim Logsdon Orkin & Hanson, P.C.

(57) ABSTRACT

A plastic lid for a pail. The lid has an edge section that extends exterior to the pail, one section of the edge section forming a hinge section. The remainder of the edge section has three sections. Each of the sections extends peripherally around the edge of the lid. One section, intermediate between the other sections is integrally formed with the other sections, and tearable therefrom. The hinge section being integral with one section and has a portion of reduced thickness juxtaposed to the rim of the container. The lid is rotatable about the hinge for opening of the pail after removal of the tearable section. The lid and pail are tamper-evident, and the lid is retained on the pail after opening.

29 Claims, 9 Drawing Sheets

FIG. 7.
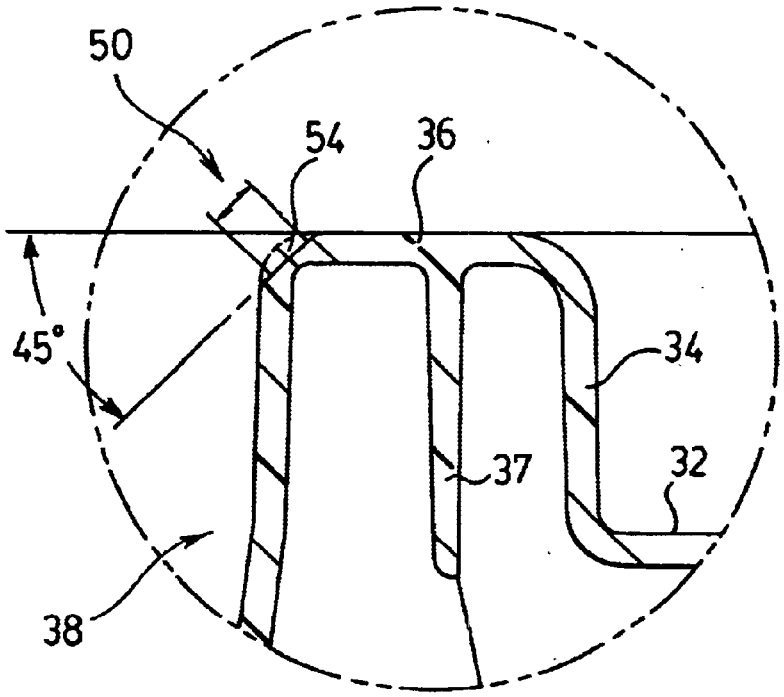
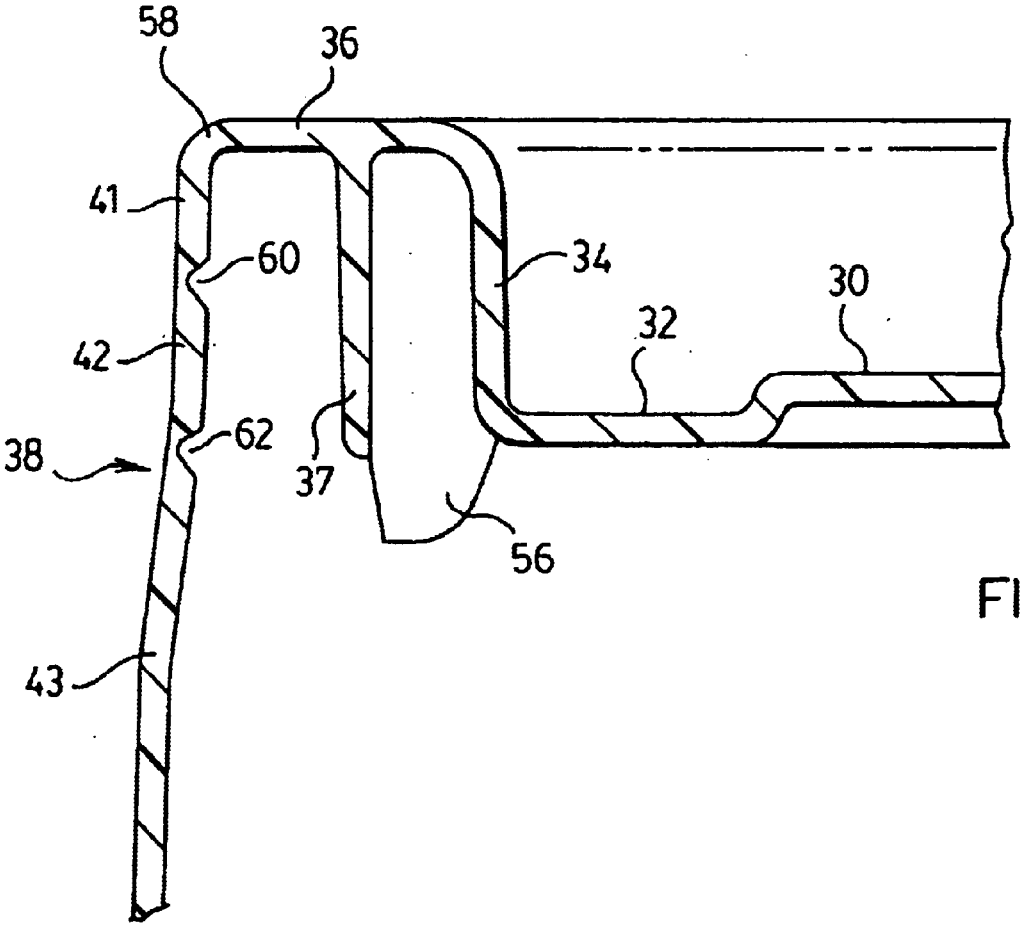
FIG. 8.

LID WITH HINGE FOR PLASTIC PAIL

FIELD OF THE INVENTION

The present invention relates to a lid for a pail, and especially to a lid for a plastic pail. In particular, the present invention relates to a lid with an integral hinge, and to a pail with such a lid. The lid forms part of the pail and remains attached to the pail after opening. In embodiments, the lid may be placed on the pail in a variety of orientations i.e. the lid does not need to be placed on the pail in a specific orientation.

The expression "pail" has been used herein to include containers. The pails may have a variety of sizes, for example sizes in the range of from about 1 L to about 25 L.

BACKGROUND TO THE INVENTION

Plastic pails are used in the packaging and transportation of a wide variety of materials, including foodstuffs, paints, chemicals, granular materials, dyes and the like. The pails are filled with the material and a lid is placed on the pail for transportation and sale, and retained there until opened for use. At the time of use, the lid of the pail is removed and must be placed somewhere while all or some of the contents of the pail are removed. Typically, the lid is placed on the floor near the pail, or on a near object. The lid, once removed, tends to become misplaced, contaminated, or even cause storage problems. Consequently, the lid may become a tripping hazard and/or be susceptible to contamination by dirt or other materials. If only some of the contents of the pail are removed, the dirty lid contaminates the remaining contents of the pail.

In some instances, the pails are of a construction that exhibits evidence of access to the contents of the pail, whether the access is intentional opening of the pail or tampering with the contents of the pail. Such pails are known as tamper-evident pails. These pails are constructed so that removal of the lid requires that a section of the pail be broken in order to remove the lid. This provides physical evidence to the consumer of the opening of or tampering with the pail.

Canadian Patent No. 2,019,225 describes a tamper-evident lid and container (pail) combination that shows physical evidence if the lid is removed. In particular, the lid has a peripheral skirt interconnected to a flange peripherally extending from the container to the lower edge of the skirt. The connections of the flange to the skirt are weak and, as such, break when the lid is removed. This provides evidence of opening of the pail.

Some containers have hinged lids to overcome these problems. For instance, a hinged lid is described in Japanese Patents Nos. 2000142758 and 2000142762. These patents describe a container having an outer lid with a coupling strap connected to both the lid and container, Lids, and pails with lids, that are not potential tripping hazards and which are less susceptible to contamination would be desirable. It is preferred that such lids also have tamper-evident characteristics, without reducing the effectiveness of the lid for subsequent use.

It would also be an advantage to provide a hinged lid that would be less bulky than the coupling strap described in the above Japanese patents, especially with respect to storage and shipping of pails and lids prior to filling.

SUMMARY OF THE INVENTION

A hinged lid, and a pail having a hinged lid, have now been found, in which the hinge is incorporated into the lid, preferably showing evidence of tampering.

Accordingly, one aspect of the present invention provides a plastic lid for a pail having a peripheral rim, said lid having a substantially planar central section integrally formed with a peripheral channel section, said channel section adapted to fit over the rim of the pail to effect closure of the pail, said channel section comprising an edge section that extends exterior to the pail around the periphery of said lid, one section of the edge section forming a hinge section and the remainder of said edge section having a first section, a second section and a third section, each of said first, second and third section extending peripherally around the edge section of the lid, said second section being intermediate said first and third sections and integrally formed with said first and third sections, said second section being tearable from the first and third sections, said hinge section being integral with said first section and having a portion of reduced thickness juxtaposed to said rim, said central section, channel and first section of the lid being rotatable about said portion of reduced thickness after tearing of said second section from said first and third sections, thereby to effect opening of the lid.

Another aspect of the present invention provides a plastic lid for a pail having a peripheral rim, said lid comprising an edge section that fits over said rim, a portion of said edge section being a hinge integrally moulded therein and forming part of said lid, said portion of the edge section other than said hinge having a removable tamper-evident tear strip, said lid being openable by rotation about said hinge after removal of the tear strip.

A further aspect of the present invention provides a pail and lid, said pail having a peripheral rim, said lid having a substantially planar central section integrally formed with a peripheral channel section, said channel section adapted to fit over the rim of the pail to effect closure of the pail, said channel section of the lid comprising an edge section that extends exterior to the pail around the periphery of said lid, one section of the edge section forming a hinge section and the remainder of said edge section having a first section, a second section and a third section, each of said first, second and third section extending peripherally around the edge section of the lid, said second section being intermediate said first and third sections and integrally formed with said first and third sections, said second section being tearable from the first and third sections, said hinge section being integral with said first section and having a portion of reduced thickness juxtaposed to said rim, said central section, channel and first section of the lid being rotatable about said portion of reduced thickness after tearing of said second section from said first and third sections, thereby to effect opening of the lid.

In another aspect, the present invention provides a plastic lid for a pail having a peripheral rim, said lid having a substantially planar central section integrally formed with a peripheral channel section, said channel section adapted to fit over the rim of the pail to effect closure of the pail, said channel section comprising an edge section that extends exterior to the pail around the periphery of said lid, one section of the edge section forming a hinge section and the remainder of said edge section having a first section and a second section, each of said first and second section extending peripherally around the edge section of the lid, said second section being distal to the periphery and integrally formed with said first section, said second section being tearable from the first section, said hinge section having a portion of reduced thickness juxtaposed to said rim, said central section, channel and first section of the lid being rotatable about said portion of reduced thickness after tearing of said second section from said first section, thereby to effect opening of the lid.

In a preferred embodiment, said hinge section has means to lock the lid onto a pail.

In a still further aspect, the present invention provides a plastic lid for a pail having a peripheral rim, said lid having a substantially planar central section integrally formed with a peripheral channel section, said channel section adapted to fit over the rim of the pail to effect closure of the pail, said channel section comprising an edge section that extends exterior to the pail around the periphery of said lid, said edge section having a first section, a second section and a third section, each of said first, second and third section extending peripherally around the edge section of the lid, said second section being intermediate said first and third sections and integrally formed with said first and third sections, said second section being tearable from the first and third sections, thereby to effect opening of the lid.

BRIEF DESCRIPTION OF THE DRAWINGS

The present invention is illustrated by the embodiments shown in the drawings, in which:

FIG. 7 is a schematic representation of the rim of section G of the lid of FIG. 6;

FIG. 8 is a schematic representation of the rim of section H of the lid of FIG. 6;

DETAILED DESCRIPTION OF THE INVENTION

Figure 1:
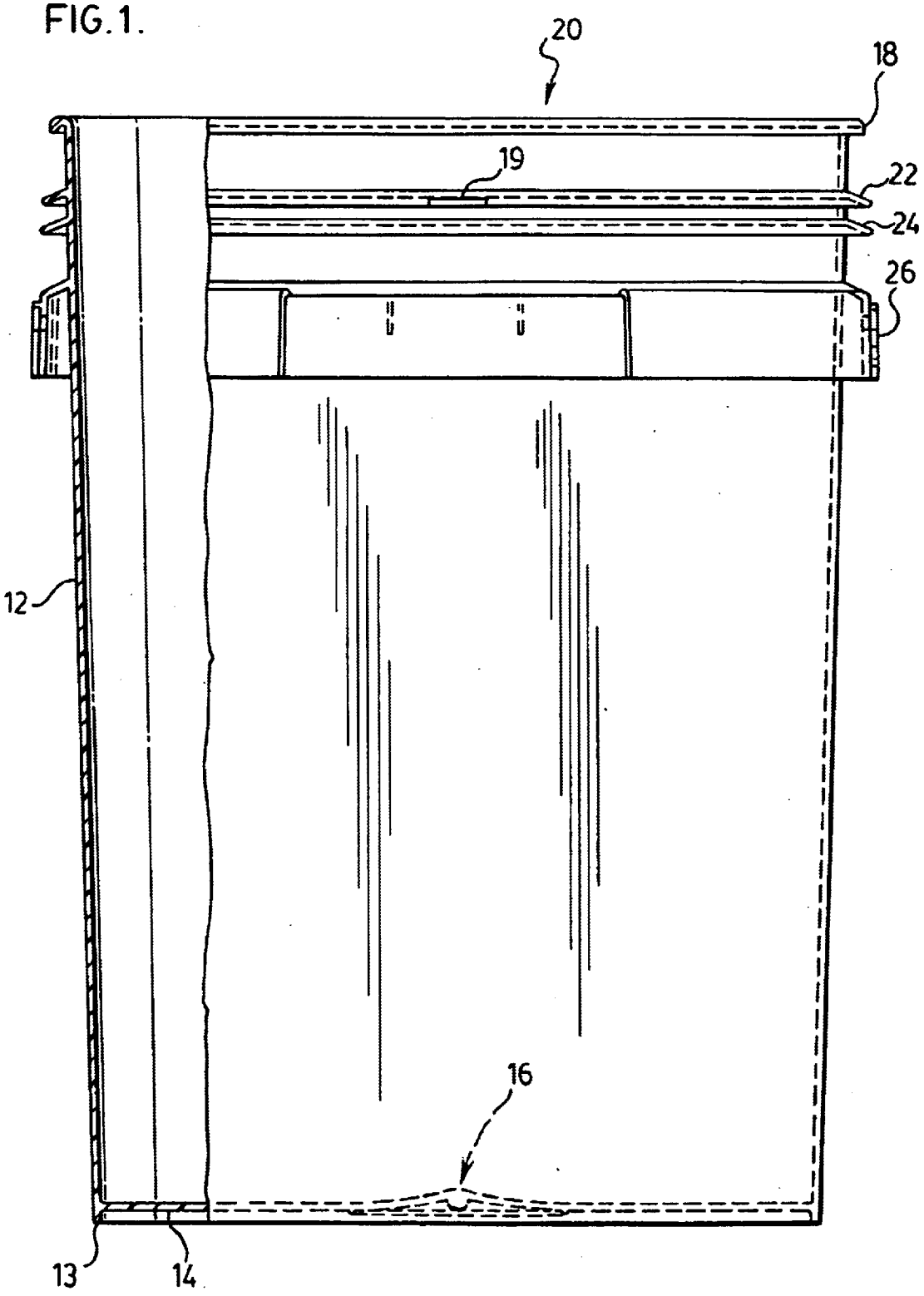
FIG. 1 is a schematic representation of a side view of a pail, partly in section.

FIG. 1 shows a plastic pail partially in section and generally indicated by 10. Pail 10 is preferably an injection moulded plastic pail, and may be formed from a variety of polymers, especially high-density polyethylene or polypropylene. Pail 10 is suitable for holding and transporting a wide variety of products or materials. Pail 10 may be made in a variety of sizes, for example sizes in the range of from about 1 L to about 25 L. In embodiments, pail 10 is a 15 L or 16 L pail. As discussed herein, pail 10 may be of any convenient cross-sectional shape, but circular, square and rectangular shapes are preferred. The invention is particularly described herein with reference to a pail with a square cross-section, which is a preferred shape.

Pail 10 has side wall 12 that extends between rim 18, at open end 20, and bottom edge 13 at bottom 14. Bottom 14 is shown as being slightly recessed from bottom edge 13, especially at gate 16, which is centrally located on bottom 14. It will be noted that side wall 12 is tapered, as is known, so that a pail 10 may be stacked with another pail 10 during transportation of empty pails.

Side wall 12 has two circumferential reinforcing ribs, 22 and 24, that are in a juxtaposed but spaced apart position on side wall 12. Ribs 22 and 24 are spaced from rim 18. Ribs 22 and 24 are moulded integrally with side wall 12. Rib 22 has latch projection 19 thereon, in a central location along the side of pail 10. Latch projection 19 projects from rib 22, and is intended to engage with a corresponding latch slot in the lid of the pail, as described below. Side wall 12 also has circumferential skirt 26 that is spaced from rib 24 and distal to rim 18. Skirt 26 is moulded integrally with side wall 12.

As discussed below, latch projection 19 in a latch slot retains the lid on the pail during transportation and storage i.e. until such time as pail 10 is to be opened. After opening, latch projection 19 in a latch slot retains the lid on the pail and provides support for the hinge.

Figure 2:
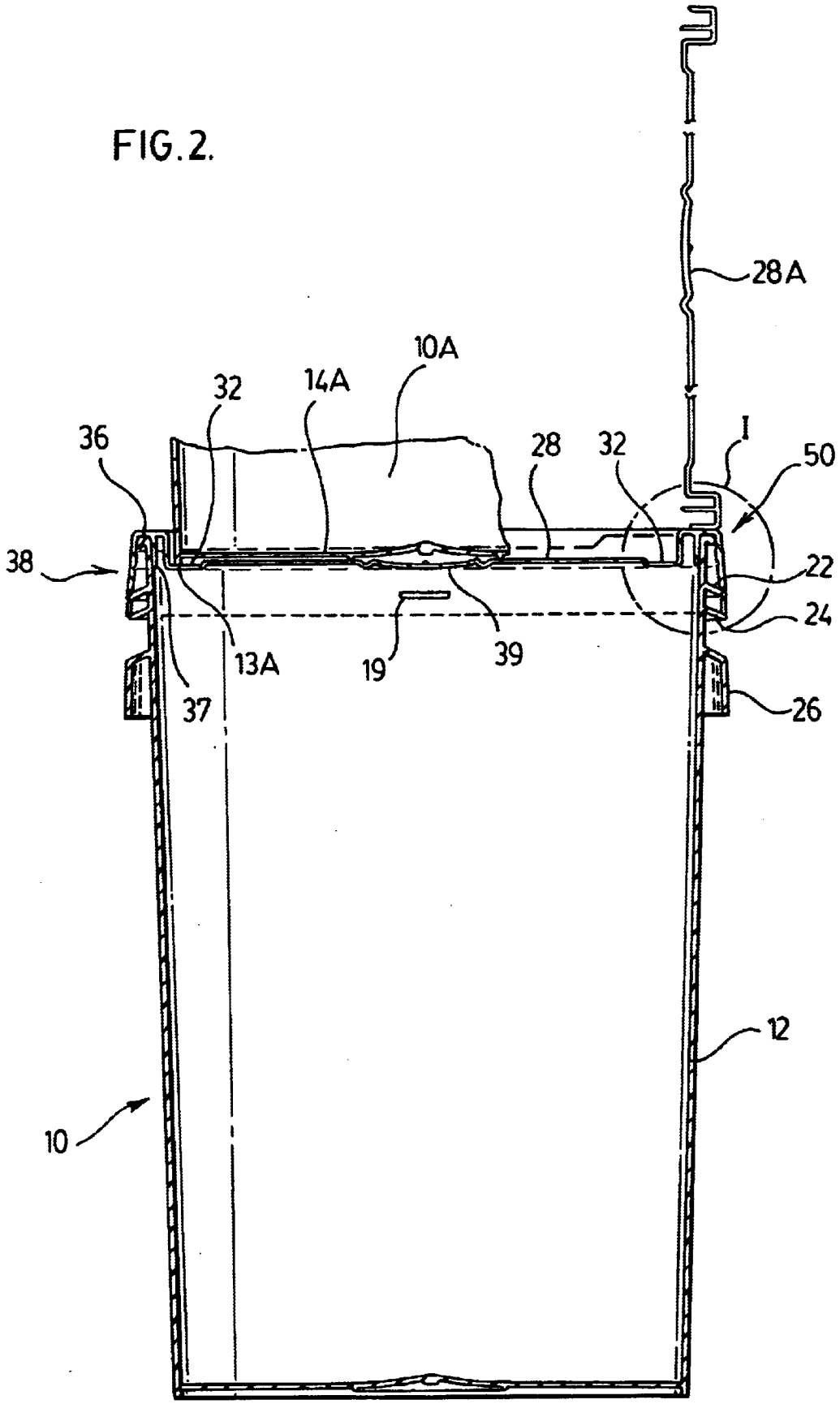
FIG. 2 is a schematic representation of a cross-section of a pail, with a lid being shown in a closed and open position.

FIG. 2 shows a cross-section of pail 10 in combination with lid 28. In addition, FIG. 2 shows a part of a second pail 10A nesting on top of lid 28, as well as showing lid 28 in an open position, as indicated by 28A. Lid 28 is preferably an injection moulded plastic lid, which may be formed from the same polymer or a different polymer from that of pail 10. A preferred polymer is polyethylene.

Lid 28 covers open end 20 of pail 10. Lid 28 has a central generally planar section, 30, which extends substantially across the width of lid 28. Central planar section 30 terminates in groove 32, which in turn is connected to lid rim 36. Lid rim 36 extends upwards from groove 32, and is an inverted U-shape to fit over rim 18 of pail 10. Lid rim 36 has an internal rib 37 within the inverted U-shape, which extends downward and is intended to be in contact with the interior surface of side wall 12, as further illustrated in FIG. 9. Internal rib 37 forms part of the seal of lid 28 with pail 10, to retain the contents of pail 10 within the pail during transportation and storage.

Central planar section 30 is recessed with respect to lid rim 36. In addition, lid 28 is shown with centre portion 39 that is slightly recessed with respect to the remainder of central planar section 30. Recessed centre portion 39 is optional and may be replaced with other shapes or omitted. It is intended that recessed centre portion 39 will facilitate stacking of another pail on lid 28, as discussed below. Centre portion 39 would normally be the location of the gate used in injection moulding of lid 28.

The periphery of lid 28 extends downwards from lid rim 36, and down the exterior of pail 10. The periphery of lid 28 forms lid edge 38, which is described in more detail below. It will be noted that lid edge 38 contacts both of reinforcing ribs 22 and 24, which will also be discussed below.

It will be noted that bottom edge 13A of pail 10A fits into groove 32 of lid 28. Bottom edge 13A is conveniently adjacent to the upwardly extending wall 34 of lid rim 36, to provide stability in the stacking of pails.

FIG. 2 also shows lid 28 on pail 10 in an open position, as indicated by 28A. Lid 28A is retained on rim 18 by hinge 50, which is discussed in greater detail below.

Figure 3:
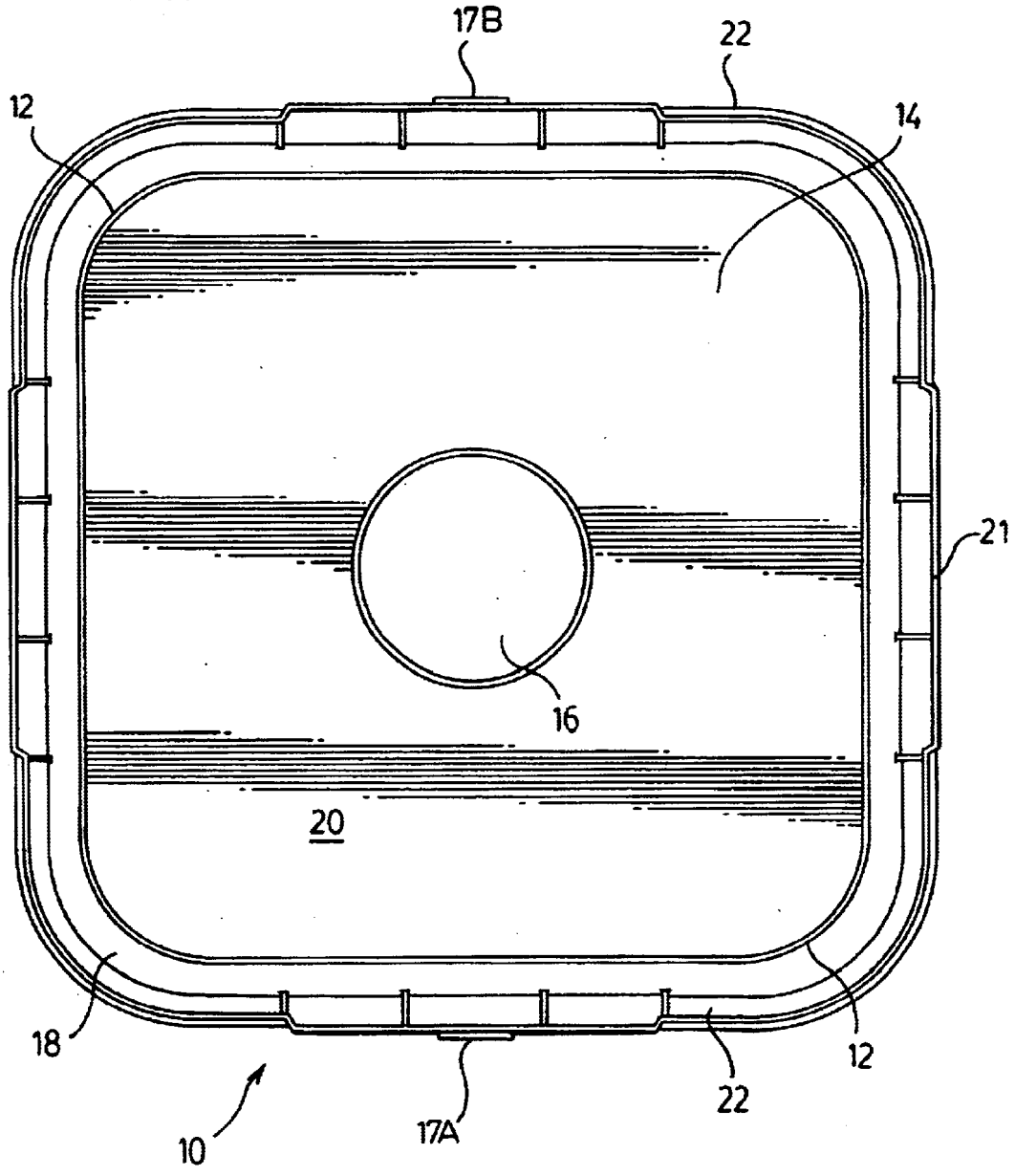
FIG. 3 is a schematic representation of a plan view of a pail, without a lid.

FIG. 3 shows a plan view of pail 10, without a lid. Thus, pail 10 has open end 20. Side wall 12, which is tapered, extends downwards to bottom 14, with gate 16 being shown. Rib 22 extends around rim 18 and is located below rim 18, as shown in FIGS. 1 and 2. Handle bases 17A and 17B extends outwards from pail 10; handle bases are further illustrated in FIG. 10. It is understood, however, that a variety of handle bases and associated handles may be used on the pail, including handles that are integrally moulded with pail 10. Pail 10 also has grips 21 that extend outwards from side wall 14.

Figure 4:
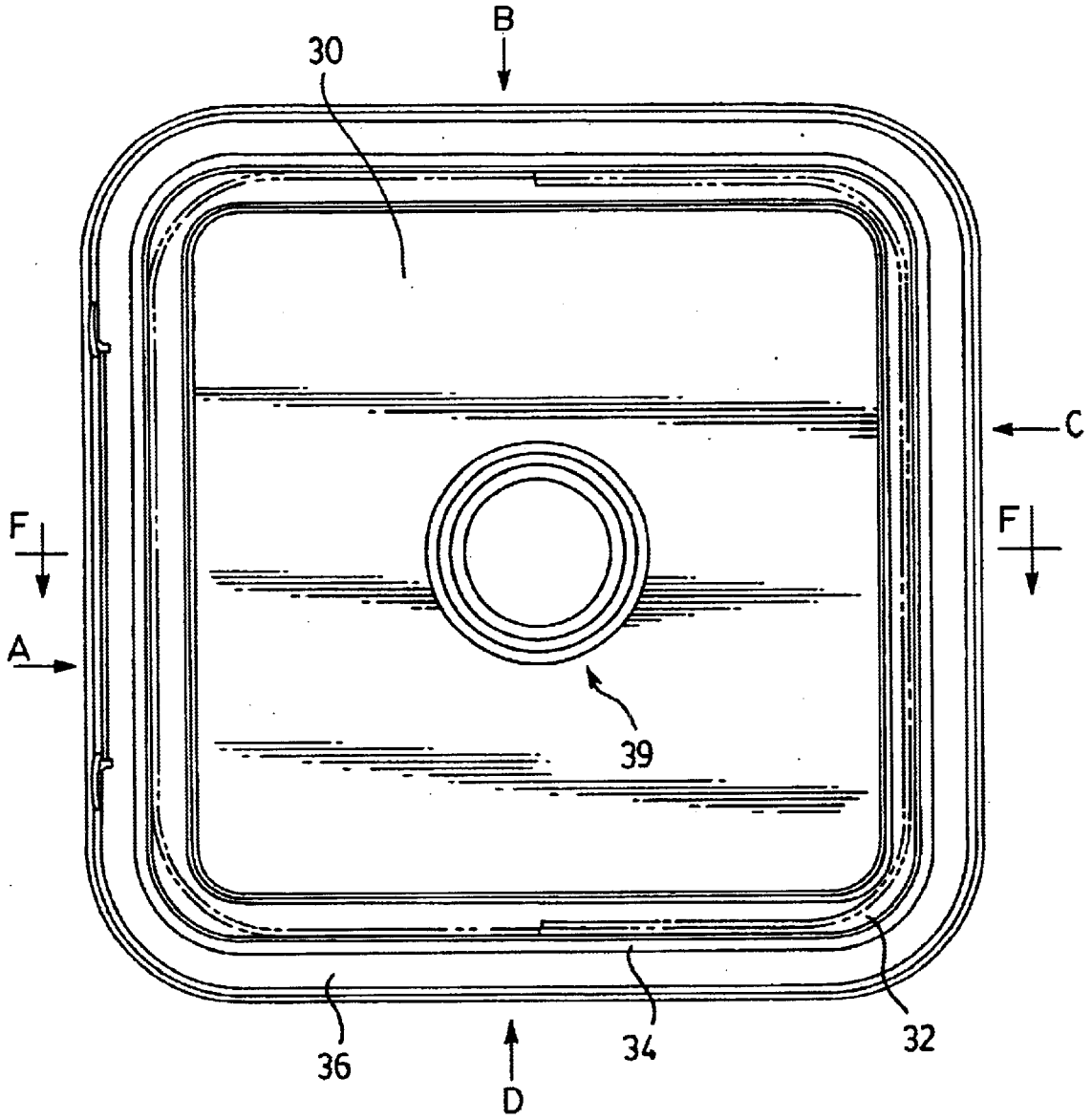
FIG. 4 is a schematic representation of a plan view of a lid.

FIG. 4 shows a plan view of lid 28. In the embodiment shown, lid 28 is a square lid, although the lid may be of other shapes. The hinge, which is not shown in FIG. 4, is integral with lid 28. Consequently, with the square lid of FIG. 4, the lid may be placed on a pail 10 in a number of orientations i.e. the lid may be rotated through 90°, 180° or 270° from the position shown and still placed directly onto pail 10. With a rectangular lid and pail, the lid could be rotated through 180°, and with a circular lid and pail, the lid could be placed on the pail at any orientation, subject to provision of latch projections. It will be appreciated that the ability to place the lid on the pail at any of the orientations that are obvious for a particular shape of lid is of substantial convenience to persons involved in the filling of pails, and is an important feature of embodiments of the present invention.

FIG. 4 shows lid 28 as having a central planar section 30. In the embodiment shown, lid 28 has centre section 39, which is optional but is typically the located of the injection moulding gate. Groove 32 extends around the periphery of central planar section 30. Groove 32 is smoothly contoured into wall 34 of lid rim 36.

Figure 4A:
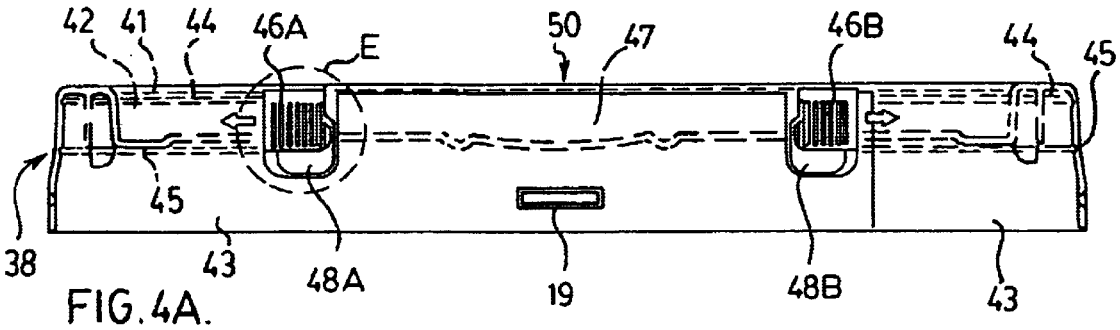
FIG. 4A is a schematic representation of a side view of the lid of FIG. 4, from position A.

FIGS. 4A–4D show edge views of lid 28, from positions A–D shown in FIG. 4. FIG. 4A shows the position of the hinge in lid 28.

Figure 4B:
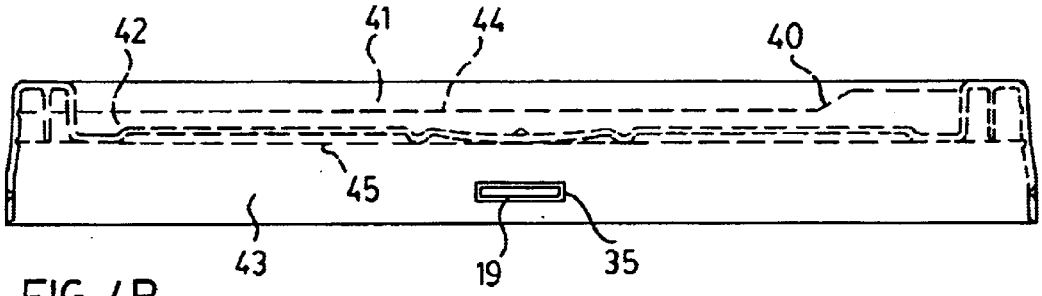
FIG. 4B is a schematic representation of a side view of the lid of FIG. 4, from position B.
Figure 4C:
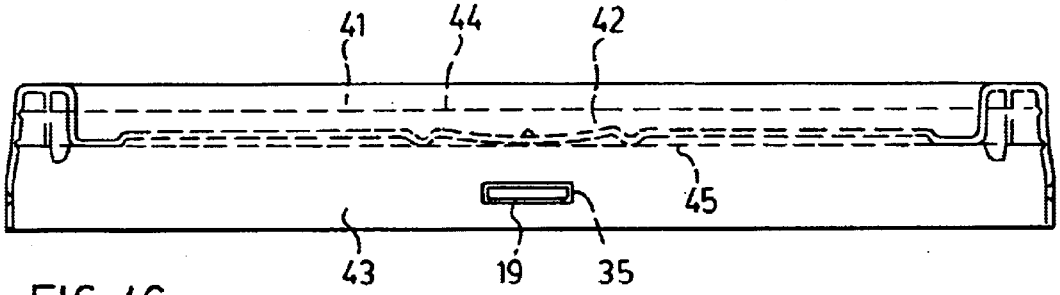
FIG. 4C is a schematic representation of a side view of the lid of FIG. 4, from position C.
Figure 4D:
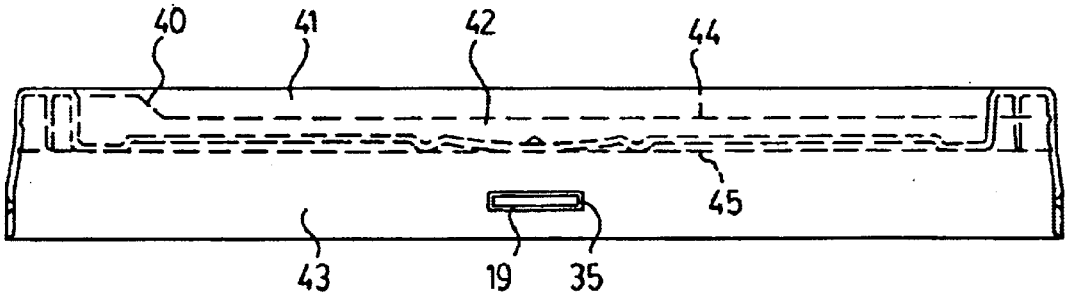
FIG. 4D is a schematic representation of a side view of the lid of FIG. 4, from position D.

FIG. 4A shows the edge of lid 28 that has the hinge section, generally indicated by 50. As shown in FIGS. 4B–4D, lid edge 38 is formed of three sections viz. first section 41, second section 42 and third section 43, with second section 42 being a breakaway section. However, at hinge section 50 shown in FIG. 4A, third section 43 extends to lid rim 36 i.e. there is no breakaway section at hinge 50. Third section 43 forms a continuous section with hinge base 47.

Latch slot 35 is centrally located in third section 43. Latch slot 35 is cooperatively located with respect to latch projection 19 on rib 22 of pail 10, to engage latch projection 19 when lid 28 is placed on pail 10 after the filling of pail 10. Moreover, it is intended that latch projection 19 be retained in latch slot 35 and only removable therefrom with excessive force. This is not necessary during normal use, because lid 28 is rendered removable from pail 10 by tearing away second section (breakaway section) 42, as discussed herein.

On the opposed sides of hinge base 47 are pull tabs 46A and 46B, with their respective finger slots 48A and 48B. Tear lines 44 and 45 extend from pull tab 46A and extend around the circumference of lid 28 to pull tab 46B. Each of pull tabs 46A and 46B is integrally connected to breakaway (second) section 42.

FIG. 4B shows a side view of lid 28. Lid edge 38 extends downwards from lid rim 36, and is formed of three sections viz. first section 41, second section 42 and third section 43. First section 41, which is the upper section, is smoothly contoured with lid rim 36. First section 41 is integrally connected to second section 42 along tear line 44. Similarly, second section 42 is integrally connected to third section 43 along tear line 45. The breakaway section (second section 42) is shown as tapering in width at taper 40. As discussed below, second section 42 is a breakaway section that may be separated from first section 41 and third section 43 by tearing along tear lines 44 and 45. This occurs during the opening of pail 10 for discharge of its contents.

First section 41 is of a narrower width along the side that has the hinge section (see FIG. 4A), to permit opening of lid 28. However, first section 41 is preferably of greater width along the remaining three sides of lid 28 so that a more effective re-closure of lid 28 may be obtained after pail 10 has been opened (see FIGS. 4B–4D).

FIG. 4B also shows latch slot 35 centrally located along lid edge 38, in third section 43 of lid edge 38.

FIG. 4D shows a view that is identical to the view of FIG. 4B, but in reverse image. However, FIG. 4C shows a view that differs from that of FIGS. 4B and 4D in that tear lines 44 and 45 are linear across the entire width of lid 28.

In operation, lid 28 is placed on pail 10 after the pail has been filled. Lid 28 is snapped closed, such that each latch projection 19 is inserted into and retained in a corresponding latch slot 35. The pail may then be shipped for sale. After sale, the pail is opened by pulling on each of pull tabs 46A and 46B, and tearing the breakaway section (section 42) away from the first and third sections (sections 41 and 43). The entire breakaway section is removed. The remaining part of lid 28 may be lifted into an open position using hinge 50. Third section 43 remains on pail 10, and forms a strap to hold hinge 50 on the pail, being anchored in position using latch projections 19 and latch slots35. Further details of the structure and operation of the hinge and breakaway section are given below.

Figure 5:
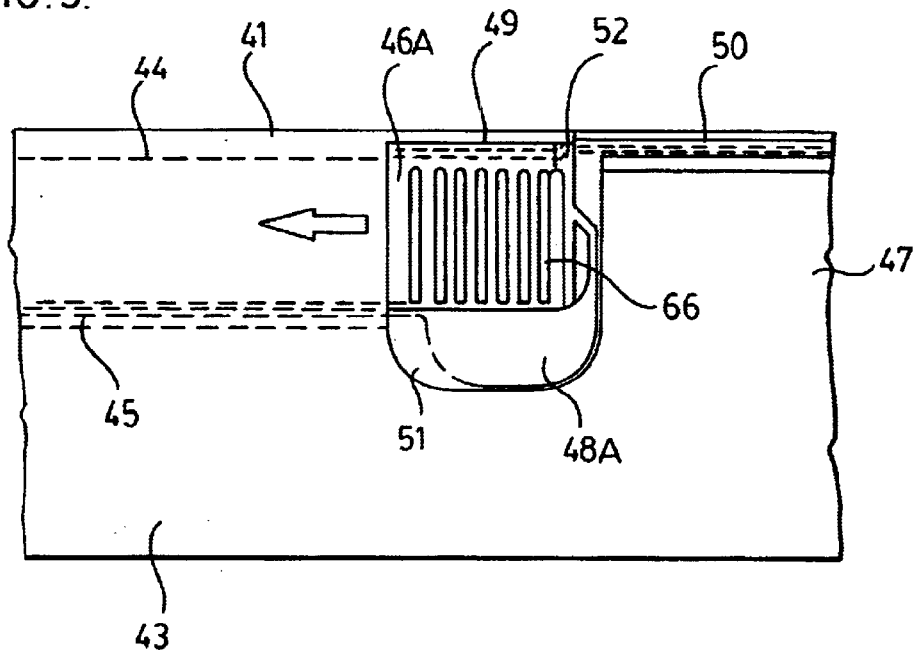
FIG. 5 is a schematic representation of the pull tab of section E of the lid of FIG. 4.

FIG. 5 shows an enlarged view of the area identified as E in FIG. 4A. Pull tab 46A is attached to second or breakaway section 42, and is adapted to tear from the lid along tab tear line 49, and then along tear lines 44 and 45. Finger slot 48A is provided so that a finger (or an instrument) may be inserted under pull tab 46A for the purpose of removal. In addition, pull tab 46A has a plurality of ridges 66, to facilitate gripping of pull tab 46A for removal thereof. Finger slot 48A has a contoured edge, at 51, for ease of entry into the slot. Pull tab 46A is separated from hinge base 47 at channel 52, for ease of opening of the lid. Channel 52 terminates at first section 41, and thus first section 41 extends into hinge 50.

Figure 6:
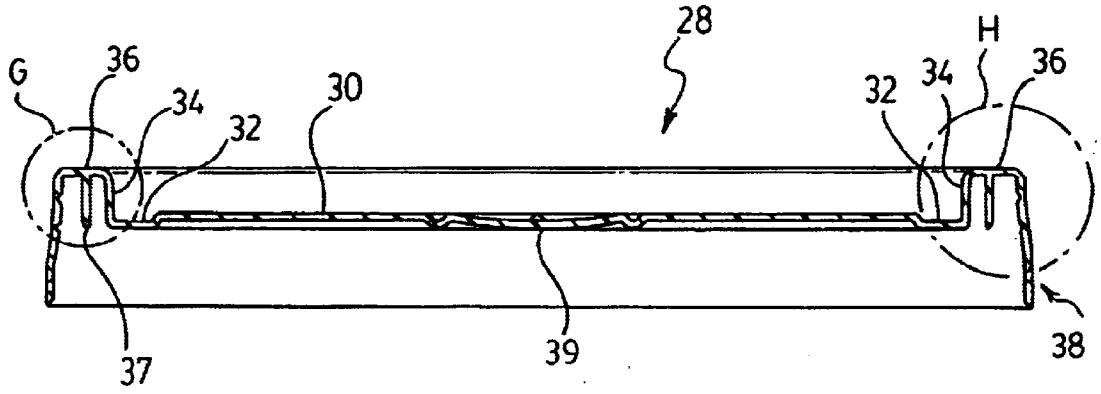
FIG. 6 is a schematic representation of a cross-section of the lid of FIG. 4, through F—F.

FIG. 6 shows a cross-section of lid 28, along line F—F of FIG. 4. Lid 28 has central planar section 30 with center portion 39. Central planar portion 30 terminates at groove 32. Wall 34 of lid rim 36 extends from groove 32 on the side opposed to central planar portion 30. Detail of the edge of lid rim 36 in the area identified as "G" is discussed below.

Lid rim 36 is smoothly contoured into lid edge 38. The construction of lid edge 38 is discussed below, with reference to "H".

FIG. 7 shows groove 32 contouring into wall 34, which in turn contours into lid rim 36. Lid rim 36 extends into lid edge 38, and forms hinge 50 in doing so. Hinge 50 is characterized by a section of reduced thickness at junction 54 between lid rim 36 and lid edge 38. The thickness of lid edge 38 at junction 54 must be such that the portion of lid with groove 32 and central planar section 30 (not shown) may be rotated about junction 54 of hinge 50, to open pail 10. When lid 28 moves upwards, lid edge 38 remains in position as it is in contact with ribs 22 and 24 as shown below. In addition to the ability to hinge at junction 54, junction 54 must be of sufficient thickness to provide strength so that lid 28 remains connected to and part of lid edge 38.

In FIG. 7, junction 54 is shown to be a planar section at an angle of 45° to the plane of lid rim 36. It is to be understood, however, that such angle may be varied e.g. through a range of 35–60° and moreover that it may be a non-planar section.

FIG. 8 shows the section identified as "H" in FIG. 6. Lid 28 has groove 32 that extends into wall 34 and to lid rim 36. Internal rib 37 extends downwards from lid rim 36 and is connected to spacer 56, which is intended to facilitate separation of lids when stacked. Lid rim 36 is contoured smoothly through edge 58 into lid edge 38. Lid edge 38 has first section 41, second (or breakaway) section 42 and third section 43. First section 41 is separated from second section 42 by notch 60, and second section 42 is separated from third section 43 by notch 62. Notches 60 and 62 correspond with tear lines 44 and 45 described above.

Figure 9:
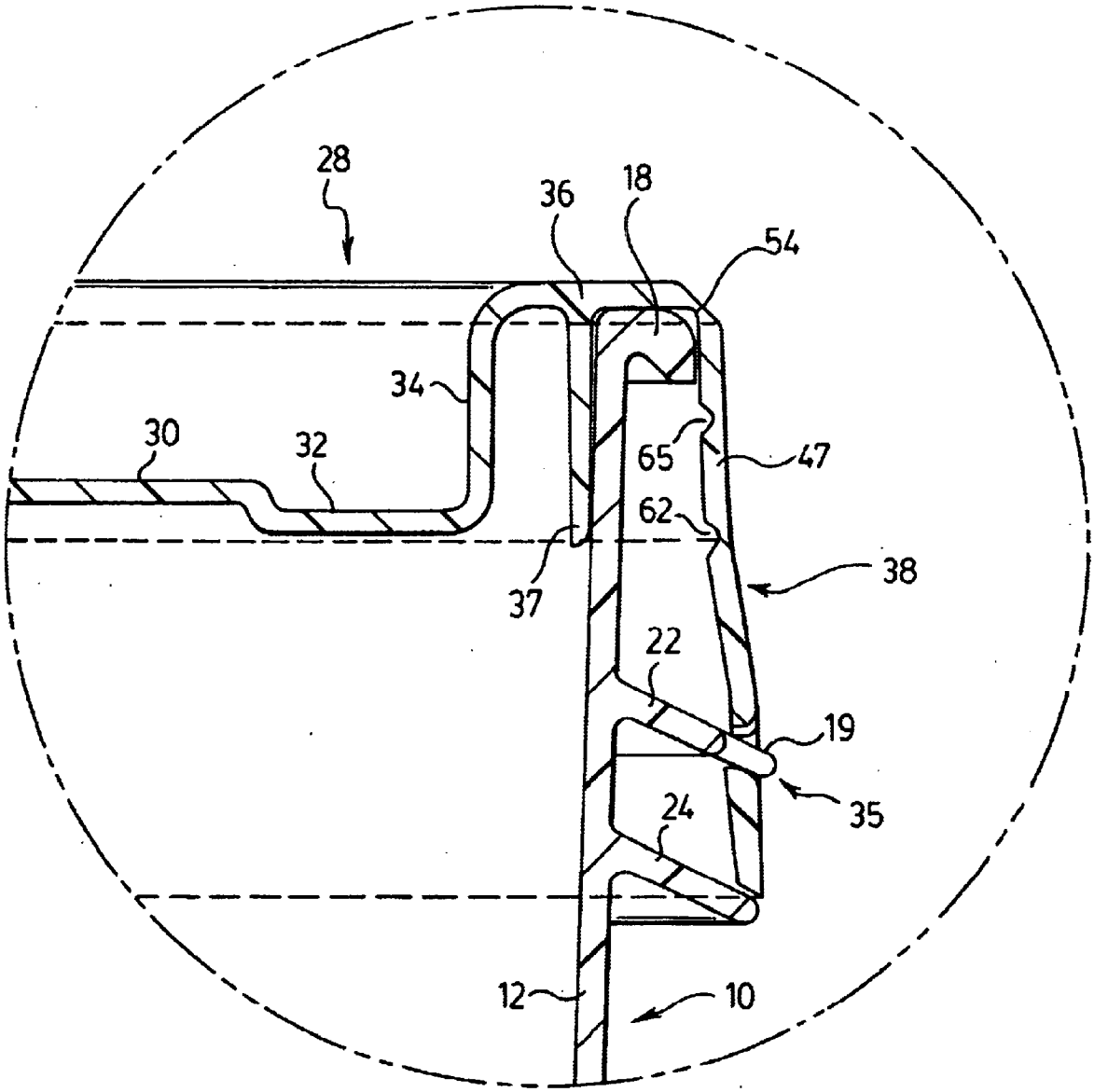
FIG. 9 is a schematic representation, in part, of the rim of section I of the lid of FIG. 2.

FIG. 9 shows a lid 28 on a pail 10, in cross section. The cross section is the area indicated as "I" in FIG. 2. Lid 28 fits over rim 18 of pail 10, with internal rib 37 against the part of side wall 12 adjacent to rim 18. Side wall 12 has ribs 22 and 24 extending therefrom. Rib 22 is shown with latch projection 19 thereon. Lid edge 38 is shown with hinge base 47 that extends downwards on the outside of side wall 12 of pail 10 past rib 22 to a position that is juxtaposed to rib 24. Latch projection 19 on rib 22 extends through latch slot 35. Latch projection 19 in latch slot 35 serves to anchor hinge base 47 on pail 10, so that it remains in position during and after opening of lid 28.

Figure 10:
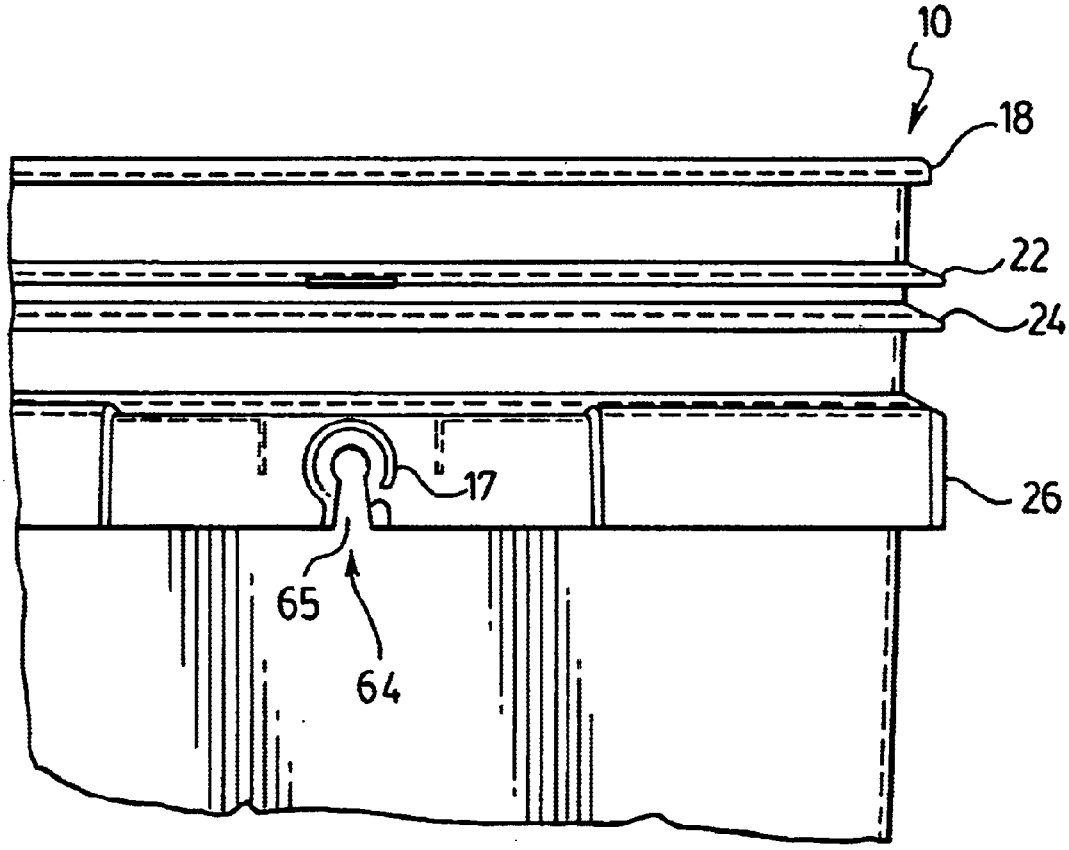
FIG. 10 is a schematic representation of a side view of a section of a pail, showing the base of a handle.

FIG. 10 shows a section of a pail 10, with rim 18, ribs 22 and 24 and skirt 26. Skirt 26 is shown as having handle connector 64 therein. Handle connector 64 has handle base 17 and handle slot 65. It is understood that a handle with cooperating sections would be fitted into handle connector 64. Such a handle is described in greater detail in U.S. Pat. No. 5,816,439. As discussed herein, any suitable handle may be attached to pail 10, and that any such handle would normally be attached into skirt 26. An appropriate connector, or entire handle, would be located as required.

In use, pail 10 is filled with the material to be packaged. Lid 28 is then applied to pail 10. As discussed above, the lid of the present invention and may be applied to a square container in any of the four possible orientations. For a rectangular container, there are two possible orientations, and for a circular container there could be a multitude of orientations. The lid is snapped closed, so that latch projections 19 enter latch slots 35 and preferably lock therein. This latches the lid to the pail, and preferably does so in a manner that prevents the lid from being removed without showing evidence of such removal. Thus, in preferred embodiments, the lid of the invention also acts as a tamper-proof and a tamper-evident lid. In such embodiments, the lid acts to provide both a hinge and evidence of tampering. For removal of the lid e.g. after transportation and sale of the filled pail, a finger or a device is inserted into one or both of finger slots 48 and the pull tab is pulled. This effects tearing of the breakaway section from the lid for the full circumference of the container except that portion where the hinge is located. Some or all of the contents of the pail may then be removed. The pail may be closed merely by closing the lid.

The lid is always conveniently located, as it remains attached to the pail. Moreover, the lid remains substantially free of contamination. For instance, the lid is not removed from the pail and placed on the floor or other object where it might be walked on, dislodged, contact dust, dirt or other contamination or misplaced. The lid is also of a construction such that it will remain closed, or at least substantially closed, after opening and re-closure.

After opening, third section 43 remains attached to the pail, and extends for the full circumference of the pail. This anchors the hinge in place, and provides stability during opening and closing of the lid. It also prevents the lid from being removed from the pail.

The invention has been described herein with reference to the lid having first section 41, second section 42 and third section 43. In an alternate embodiment of the invention, third section 43 is omitted from the lid. Thus, the lid would have first section 41 and second section 42, the latter being a breakaway section as described herein. After removal of second section 42, the lid would have first section 41 but the third section described previously and which retains the lid on the pail would be absent. Alternate means of attachment of first section 41 to the pail may be required e.g. ratchet systems, hooks, interlocking curved sections or other locking systems. Such locking systems would preferably be integrally moulded into the lid and/or pail. Thus, in use second section 42 would show evidence of opening of the pail i.e. evidence of tampering, and the lid would normally be retained on the pail after opening.

In a further embodiment, second section 42 could be a breakaway section around the entire circumference of the lid. In this embodiment, second section 42 would be a breakaway section through the hinge section described above. Consequently, the lid would be detachable from the pail, being no longer a hinged lid. Third section 43 would remain on the pail, and would be evidence of tampering with the pail. In this embodiment, the hinge section described above could be omitted. The lid after removal of second section 42 would be a replaceable lid. The lid and pail would be a tamper evident combination, but without a hinged lid.

The hinged lid of the present invention, the pail and the pail with lid are capable of being stacked and shipped, both filled and prior to filling. Thus, the lid and pails are convenient for storage, easily assembled after filling of the pail, are stackable for shipping either separately or filled and show evidence of any tampering or opening. The alternate embodiments further provide lids and pails that show evidence of tampering.

What is claimed is:

1. A plastic lid combination, comprising:

a pail comprising a side wall tapering from a peripheral rim defining a pail opening to a smaller bottom portion and a lid comprising an edge section that extends exterior to the pail around the periphery of said lid, the edge section having a peripheral channel section, said channel section cooperating with the rim of the pail to effect closure of the pail, the lid further comprising a substantially planar section integrally formed with the channel section, one section of the edge section adjacent said rim forming a hinge section and the remainder of said edge section located adjacent to and below said hinge section and having a first section. a second section and a third section, each of said first, second and third section extending peripherally around the edge section of the lid, said second section being intermediate said first and third sections and integrally formed with said first and third sections, said second section being tearable from the first and third sections, said hinge section being integral with said first section and having a portion of reduced thickness juxtaposed to said rim and located in a plane encompassing a top edge of a rim of the pail or above said plane, said central section, channel and first section of the lid being rotatable about said portion of reduced thickness after tearing of said second section from said first and third sections, thereby to effect opening of the lid.

2. The lid of claim 1 in which said third section is adapted to be attached to the pail.

3. The lid of claim 2 in which the first section connects to the third section at said hinge.

4. The lid of claim 2 in which the first section is of a shape to permit reclosure of said lid on the pail.

5. The lid of claim 2 in which the lid is adapted to be attached to the pail such that said second section must be torn from the first and third sections to effect opening of the lid.

6. The lid of claim 5 in which the lid has at least one latch slot that is adapted to engage with a latch projection cooperatively located on a pail.

7. The lid of claim 5 in which the second section has a tab means for effecting removal of the second section.

8. The lid of claim 1 in which the lid is a tamper-evident lid.

9. The lid of claim 8 in which the lid is square.

10. The lid of claim 8 in which the lid is rectangular.

11. The lid of claim 8 in which the lid is circular.

12. The lid of claim 8 in which the lid is formed of a plastic selected from the group consisting of high density polyethylene and polypropylene.

13. The lid of claim 8 in which the lid is stackable.

14. The lid of claim 13 in which the lid is adapted for the stacking of pails with lids.

15. A plastic lid for a pail having a peripheral rim, said lid having a substantially planar central section integrally formed with a peripheral channel section, said channel section adapted to fit over the rim of the pail to effect closure of the pail, said channel section comprising an edge section that extends exterior to the pail around the periphery of said lid, one section of the edge section adjacent said rim forming a hinge section and the remainder of said edge section located adjacent to and below said hinge section and having a first section, a second section and a third section, each of said first, second and third section extending peripherally around the edge section of the lid, said second section being intermediate said first and third sections and integrally formed with said first and third sections, said second section being ternable from the first and third sections, said third section is adapted to be attached to the pail, said lid is adapted to be attached to the pail such that said second section must be torn from the first and third sections to effect opening of the lid, said hinge section being integral with said first section and having a portion of reduced thickness juxtaposed to said rim, said central section, channel and first section of the lid being rotatable about said portion of reduced thickness after tearing of said second section from said first and third sections, thereby to effect opening of the lid, wherein the lid has at least one latch slot that is adapted to engage with a latch projection cooperatively located on a pail, wherein the at least one latch slot is located in the third section.

16. A plastic lid for a pail having a peripheral rim, said lid having a substantially planar central section integrally formed with a peripheral channel section, said channel section adapted to fit over the rim of the pail to effect closure of the pail, said channel section comprising an edge section that extends exterior to the pail around the periphery of said lid, one section of the edge section adjacent said rim forming a hinge section and the remainder of said edge and located adjacent to and below said hinge section and having a first section, a second section and a third section, each of said first, second and third section extending peripherally around the edge section of the lid, said second section being intermediate said first and third sections and integrally formed with said first and third sections, said second section being tearable from the first and third sections, said third section is adapted to be attached to the pail, the lid is adapted to be attached to the pail such that said second section must be torn from the first and third sections to effect opening of the lid, said hinge section being integral with said first section and having a portion of reduced thickness juxtaposed to said rim, said central section, channel and first section of the lid being rotatable about said portion of reduced thickness after tearing of said second section from said first and third sections, thereby to effect opening of the lid, in which the latch slot is located in the third section, wherein there are a plurality of latch slots, at least one latch slot being in the third section adjacent the hinge, and at least one latch slot is adapted to engage with a latch projection cooperatively located on a pad.

17. The lid of claim 16 in which the lid is square or rectangular, and the lid has at least four latch slots.

18. A plastic lid combination comprising;

a pad comprising a side wall tapering from a peripheral rim defining a pail opening to a smaller bottom portion; and a lid comprising an edge section that fits over said rim, a portion of said edge section being a hinge integrally moulded therein and forming part of said lid and located in a plane encompassing a top edge of a rim opening of the pail or above said plane, said portion of the edge section located adjacent to and below said hinge having a removable tamper-evident tear strip, said lid being openable by rotation about said hinge after removal of the tear strip.

19. A pail lid combination, comprising:

a pail comprising a side wall tapering from a peripheral rim defining a pail opening to a smaller bottom portion; and a lid comprising an edge section that extends exterior to the pail around the periphery of said lid, the edge section having a peripheral channel section, said channel section cooperating with the rim of the pail to effect closure of the pail, the lid further comprising a substantially planar section integrally formed with the channel section, one section of the edge section adjacent said rim forming a hinge section and the remainder of said edge section located adjacent to and below said hinge section and having a first section, a second section and a third section, each of said first, second and third section extending peripherally around the edge section of the lid, said second section being intermediate said first and third sections and integrally formed with said first and third sections, said second section being tearable from the first and third sections, said hinge section being integral with said first section and having a portion of reduced thickness juxtaposed to said rim and located in a plant encompassing a top edge of a rim of the pail or above said plane, and said central section, channel and first section of the lid being rotatable about said portion of reduced thickness after tearing of said second section from said first and third sections, thereby to effect opening of the lid.

20. The pail and lid of claim 19 in which said third section is attachable to the pail.

21. The pail and lid of claim 19 in which the lid is a tamper-evident lid.

22. The pail and lid of claim 19 in which the lid is attachable to the pail such that said second section must be torn from the first and third sections to effect opening of the lid.

23. The pail and lid of claim 22 in which the lid fits on the pail by a snap-fit.

24. The pail and lid of claim 19 in which the pail and lid have a shape selected from the group consisting of square, rectangular and circular.

25. The pail and lid of claim 24 in which the lid may be placed on the pail at more than one orientation.

26. A pail and lid, said pail having a peripheral rim, said lid having a substantially planar central section integrally formed with a peripheral channel section, said channel section adapted to fit over the rim of the pail to effect closure of the pail, said channel section of the lid comprising an edge section that extends exterior to the pail around the periphery of said lid, one section of the edge section adjacent said rim forming a hinge section and the remainder of said edge section located adjacent to and below said hinge section and having a first section, a second section and a third section, each of said first, second and third section extending peripherally around the edge section of the lid, said second section being intermediate said first and third sections and integrally formed with said first and third sections, said second section being tearable from the first and third sections, said hinge section being integral with said first section and having a portion of reduced thickness juxtaposed to said rim, and said central section, channel and first section of the lid being rotatable about said portion of reduced thickness after tearing of said second section from said first and third sections, thereby to effect opening of the lid, wherein the pail has latch projections and the lid has cooperatively located latch slots, said latch projections fitting into said latch slots when the lid is placed on the pail.

27. A plastic lid and pail combination, comprising:

a pail comprising a side wall tapering from a peripheral rim defining a pail opening to a smaller bottom portion; and a lid comprising an edge section that extends exterior to the pail around the periphery of said lid, the edge section having a peripheral channel section, said channel section cooperating with the rim of the pail to effect closure of the pail, the lid further comprising a substantially planar section integrally formed with the channel section, one section of the edge section adjacent said rim forming a hinge section and the remainder of said edge section located adjacent to and below said hinge section and having a first section and a second section, each of said first and second section extending peripherally around the edge section of the lid, said second section being distal to the periphery and integrally formed with said first section, said second section being tearable from the first section, said hinge section having a portion of reduced thickness juxtaposed to said rim and located in a plane encompassing a top edge of a rim of the pail or above said plane, and said central section, channel and first section of the lid being rotatable about said portion of reduced thickness after tearing of said second section from said first section, thereby to effect of the lid.

28. The plastic lid of claim 27 in which said hinge section has means to lock the lid onto a pail.

29. A plastic lid and pail combination, comprising:

a pail comprising a side wall tapering from a peripheral rim defining a pail opening to a smaller bottom portion; and a lid comprising an edge section that extends exterior to the pail around the periphery of said lid, the edge section having a peripheral channel section, said channel section cooperating with the rim of the pail to effect closure of the pail, the lid further comprising a substantially planar section integrally formed with the channel section, one section of the edge section adjacent the rim forming a hinge section and the remainder of the edge section located adjacent to and below the hinge section and having a first section, a second section and a third section, each of said first, second and third section extending peripherally around the edge section of the lid, said second section being intermediate said first and third sections and integrally formed with said first and second section, said second section being tearable from the first and second sections, thereby to effect opening of the lid, said hinge section being integral with the first section and having a portion of reduced thickness juxtaposed to the rim and located in a plane or encompassing a top edge of a rim of the pail or above said plane.

* * * * *

UNITED STATES PATENT AND TRADEMARK OFFICE

CERTIFICATE OF CORRECTION

PATENT NO. : 6,712,233 B2
DATED : March 30, 2004
INVENTOR(S) : Stephen H. Arshinoff It is certified that error appears in the above-identified patent and that said Letters Patent is hereby corrected as shown below:

Column 8,
Line 53, “lid combination” should read -- lid and pail combination --
Line 56, “and” should read -- ; and --

Column 9,
Line 1, “a first section.” should read -- a first section, --

Colujmn 10,
Line 42, “located on a pad” should read -- located on a pail --
Line 45, “A plastic lid” should read -- A plastic lid and pail --
Line 46, “a pad comprising” should read -- a pail comprising --

Column 12,
Line 30, “to effect of” should read -- to effect opening of --

Signed and Sealed this

Seventeenth Day of August, 2004

JON W. DUDAS
*Acting Director of the United States Patent and Trademark Office*